US005115715A

United States Patent [19]

Lindberg et al.

[11] Patent Number: 5,115,715

[45] Date of Patent: May 26, 1992

[54] BREECH MECHANISMS

[75] Inventors: Sven Lindberg, Degerfors; Kjell Eriksson, Karlskoga, both of Sweden

[73] Assignee: Aktiebolaget Bofors, Bofors, Sweden

[21] Appl. No.: 530,342

[22] Filed: May 30, 1990

[30] Foreign Application Priority Data

May 30, 1989 [SE] Sweden ..... 8901919-4

[51] Int. Cl.[5] ..... F41A 3/74

[52] U.S. Cl. ..... 89/26

[58] Field of Search ..... 89/4.2, 24, 26

[56] References Cited

U.S. PATENT DOCUMENTS

| | | | |
|---|---|---|---|
| 258,116 | 5/1882 | Quick | 89/24 |
| 487,380 | 12/1892 | Seaburg | 89/26 |
| 1,576,962 | 3/1926 | Froelich | 89/24 |
| 2,444,633 | 7/1948 | Crossley | 89/26 |

FOREIGN PATENT DOCUMENTS

| | | |
|---|---|---|
| 0014559 | 8/1980 | European Pat. Off. . |
| 0595265 | 12/1947 | United Kingdom . |

*Primary Examiner*—Stephen C. Bentley

*Attorney, Agent, or Firm*—Pollock, Vande Sande & Priddy

[57] ABSTRACT

A breech mechanism for large caliber artillery pieces is characterized by a specifically designed sealing function in the form of an intermediate layer between a main portion of the breech mechanism and a seating portion displaceable in relation thereto by the gas pressure in the gun. The seating portion, on being displaced towards the breech, compresses the intermediate layer disposed therebetween and consisting of an elastically deformable refractory material which, on its deformation, is urged into tight abutment against the rear portion of the gun barrel about the loading space of the gun along a gap between the seating portion and the main portion of the breech mechanism.

14 Claims, 2 Drawing Sheets

BREECH MECHANISMS

TECHNICAL FIELD

The present invention relates to a mechanism for large caliber guns including a breech block mechanism laterally displaceable transversely of the rear region of the gun barrel and disposed in a groove adapted therefore in the breech piece of the gun, this in its turn being fixedly connected to the barrel of the gun. The breech is displaceable, in a conventional manner from a first loading position where it leaves the rear loading aperture of the barrel completely open, to a second position where it wholely seals the loading aperture. By means of a special design of the breech, it has become possible to render the breech so gastight in the closed position that it may also be employed for caseless ammunition and ammunition with combustible cases.

BACKGROUND ART

In particularly large caliber ordnance such as artillery guns, only two different types of mechanisms are fundamentally conceivable. The first and most widely used but at the same time also most expensive and difficult to manufacture is the so-called screw mechanism in which the loading aperture of the gun barrel is closed by means of a special impact base with associated obturation pad, a so-called Crossly pad, which in turn is supported by a chamber screw functioning as an abutment. This latter displays outer alternatingly smooth and threaded sectors which are inserted into a correspondingly adapted and correspondingly sectorwise threaded locking portion in the breech piece of the gun, where the chamber screw is then locked by a turning movement which causes the different threads to intermesh. The major advantage inherent in this type of mechanism is that it is so gastight that it can be employed for caseless ammunition, for example when the gun is loaded with a shell and one or more separate propellant charges, so-called bag charges, or when use is made of combustible cases, and thus provides no sealing aid on firing as is provided by a cartridge case expanded by the gas pressure.

The second basic type of mechanism is the so-called sliding breech mechanism in which use is made of a breech mechanism displaceable transversely of the loading aperture of the gun barrel in a groove adapted therefore in the breech piece of the gun fixedly connected to the gun barrel, for rearward closing and sealing of the gun barrel. Even if the breech mechanism may be provided with such a path of motion that it is urged against the rear portion of the gun barrel when it is displaced from its open loading position to its fully closed firing position, this type of mechanism will not in itself be sufficiently gastight for use with other than cased ammunition. On the other hand, it functions very well in connection with such cased ammunition, in which the cartridge cases may be utilized as a seal against the inner gas pressure.

However, a considerable amount of development work has been devoted to producing "tight" breech mechanisms. In one of these, use is made of an annular resilient sealing plate of metal as a seal between the gun barrel and the breech mechanism. Such sealing plate has an angular cross-section and is turned with its one flank to face the outer edge of an annular groove disposed about the inside of the rear portion of the gun barrel, while the other free flank of the sealing plate is turned to face the breech mechanism. The sealing function is based on the concept that the gas pressure within the gun barrel will urge the free flank of the sealing plate against the block mechanism and seal thereagainst. The design as such may be rendered sufficiently tight for employment together with caseless ammunition, but at the same time it is prone to damage, not least to the resilient sealing flank of the sealing plate and consequently there has been general reluctance to introduce this type of design, since such damage to the sealing plate may cause a considerable blow-back, which would of course constitute a serious risk to the gun crew.

Patent specification EP-A1-0014559 further describes a two-part breech mechanism (previously unknown to us) comprising a first locking device displaceable transversely of the longitudinal direction of the gun barrel and a sealing device interconnected therewith which, in turn, is displaceable both transversely of the gun barrel and, in the closing position, partly into the rear opening thereof where it is blocked by the locking device. The configuration of that part of the sealing device which is inserted in the rear region of the gun barrel is described in that specification as a mushroom provided with a stem seal disposed about the neck of the mushroom. The problem which may be directly foreseen with this design is that the stresses on parts of the stem seal must be extremely high, since parts thereof, even if the greater part is protected by the mushroom hat, are disposed directly in the line of fire from the propellant charge combustion.

SUMMARY OF THE INVENTION

In accordance with the present invention, use is made of a two-part breech mechanism consisting of a conventionally designed main portion and a seating portion journalled therein and restrictedly movable. Between the seating portion which, with the locking breech in the closed position, wholly covers the rear loading aperture of the gun barrel, and the main portion of the locking breech, there is provided according to the present invention an elastically deformable intermediate layer of a refractory natural or synthetic rubber, for example nitrile rubber. The main portion and seating portion of the breech mechanism display mutually facing concave and convex defining surfaces between which the elastically deformable intermediate layer is thus disposed. These defining surfaces are formed by different concave and convex cams respectively, for example in the form of parabolic parts which have been rotated about a common axis. The shape of these cams must be empirically tested in view of caliber, gas pressure in the gun and the thickness and physical properties of the intermediate layer. It has also proved appropriate to cause the space which the intermediate layer has accessible between the two parts to flare somewhat towards the annular gap which is formed about the outer surface of the seating portion turned to face the loading aperture of the gun barrel. On firing of the gun, the outer surface of the seating portion is influenced by the gas pressure, the intermediate layer being compressed and its only direction of creepage being then towards the rear portion of the gun barrel around the loading aperture. There will thus be obtained, because the seating portion lacks a counter-abutment for its central region in the block, an elevation of the gas pressure in the gun barrel to a higher pressure in the intermediate layer. Consequently, the interface contact pressure between the intermediate layer and the gun barrel will always be higher than the gas pressure, which thus ensures the sealing function. In other words, the higher the gas pressure in the gun, the more efficient will be the sealing. Along the gap in question, the intermediate layer should be shod with metal rings or rings of other material which are intractable both a direction in towards the loading aperture and away therefrom. In the first case mainly as protection against flash jets and in the second case to prevent creepage of the intermediate layer between the breech and the rear portion of the gun barrel.

The material in the intermediate layer must be hard but elastically deformable, while on the other hand it should possess only very slight natural compressibility. In addition, it must be of a refractory nature, for which reason nitrile rubber material, for instance, should be ideal.

For elevation of the gas pressure and for guiding the seating portion in the main portion of the breech mechanism the seating portion is provided with a central pin which runs through a specifically adapted aperture in the intermediate layer and is restrictedly displaceable in the main portion of the breech mechanism. The detonation mechanism may also be disposed in this pin. This central pin may further be employed for precompressing the intermediate layer already before the seating portion is actuated by the gas pressure and thereby positively realize the sealing function already prior to firing of the gun, that is as soon as the breech has been closed. This is achieved most simply in that the central pin is mechanically or hydraulically retracted in the main portion of the mechanism breech, in which event the intermediate layer is, thus, urged towards the rear portion of the gun barrel along the previously mentioned annular gap around the seating portion. Another variation is based on the concept that the intermediate layer is always given a certain precompression via a continuous pull in the central pin so that it constantly protrudes out beyond the mechanism breech, and that the latter, when the mechanism is closed, is urged in a somewhat oblique path in relation to the gun barrel towards the rear wall of the barrel and thereby further compresses the intermediate layer along the annular gap towards the rear region of the gun barrel around the loading aperture.

The device according to the present invention will now be described further with reference to the accompanying Drawings representing the preferred embodiments of the present invention.

In the accompanying Drawings:

DESCRIPTION OF PREFERRED EMBODIMENT

Figure 1:
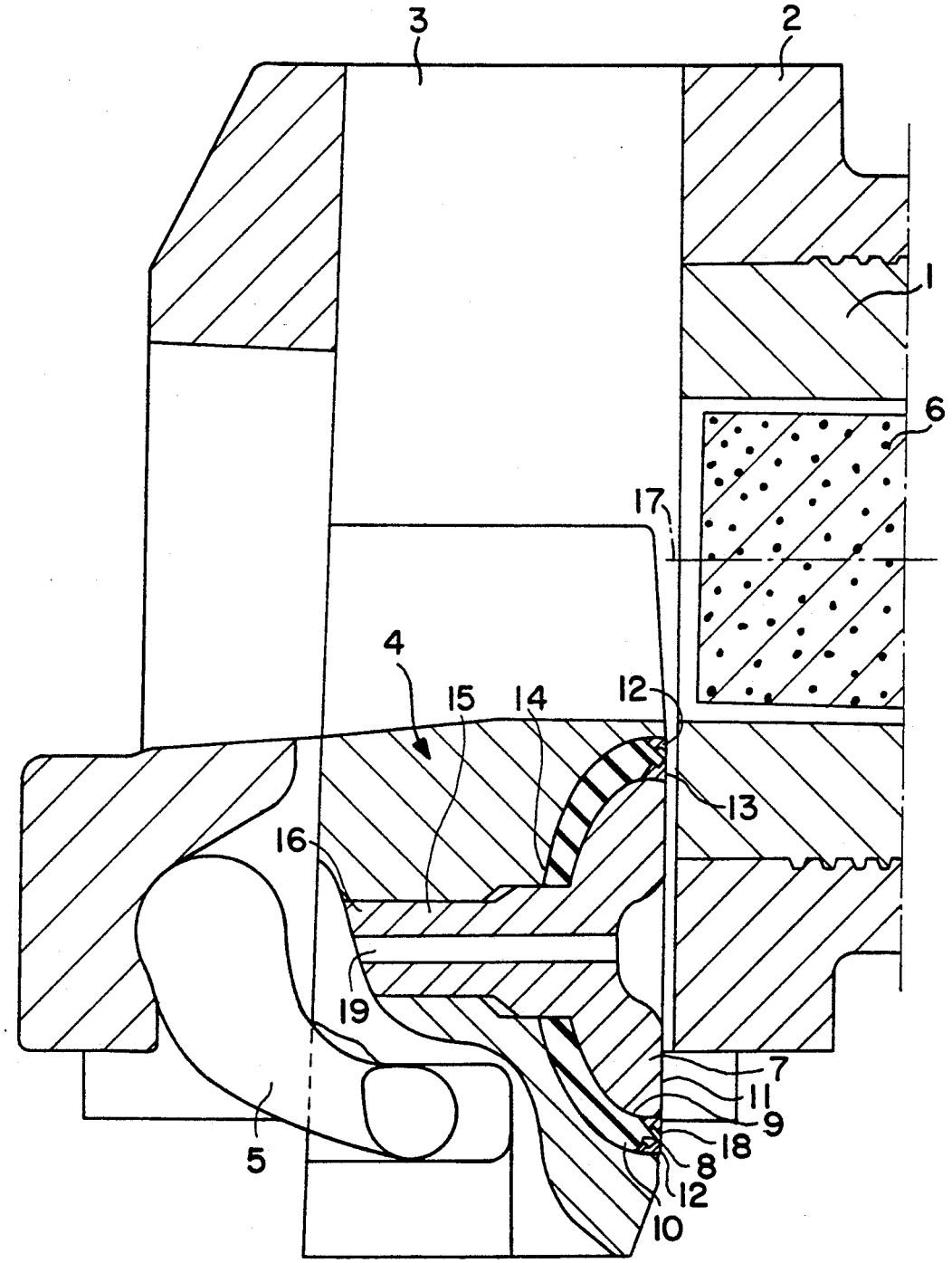
FIG. 1 is a longitudinal section through the apparatus according to the present invention with the breech mechanism in the open position.

The figures show only the rear portion of the gun, with a gun barrel 1, a breech piece 2 fixedly connected to the gun barrel, with a guide groove 3 for the breech mechanism 4. This latter is operated from its open position illustrated in FIG. 1 to its closed position illustrated in FIG. 2 by means of the crank 5. A charge 6 is already placed in the chamber of the barrel 1, the charge being of bag charge type or with a combustible case.

The seating portion 7 is journalled in the main portion of the breech mechanism. Between the seating portion and the main portion of the breech mechanism, there is provided an intermediate layer 8 of a hard but deformable refractory natural or synthetic rubber or plastic material. The convex and concave defining surfaces 9, 10, respectively of the seating portion and the main portion of the breech mechanism are formed by cams which constitute parts of different parabola rotated about one and the same axis which coincides with the bore axis 17 of the gun barrel. As will be apparent from the Drawings, the gap accessible for the intermediate layer is flared towards the annular gap 18 which is formed about the front face 11 of the seating portion turned to face the charge. The intermediate layer is shod with metal rings 12–14. The ring 13 primarily protects against flash jets, since it is turned to face towards the loading space of the gun, while both of the other rings 12 and 14 are intended to prevent the material of the intermediate layer from creeping out into the gaps between adjacent mechanism parts.

As will further be apparent from the Drawings, the seating portion is journalled in the major portion of the breech mechanism by means of a pin 15 which passes through an aperture 16 in the intermediate portion, flush with the ring 14. The detonation system 19 is also disposed in the pin 15.

Figure 2:
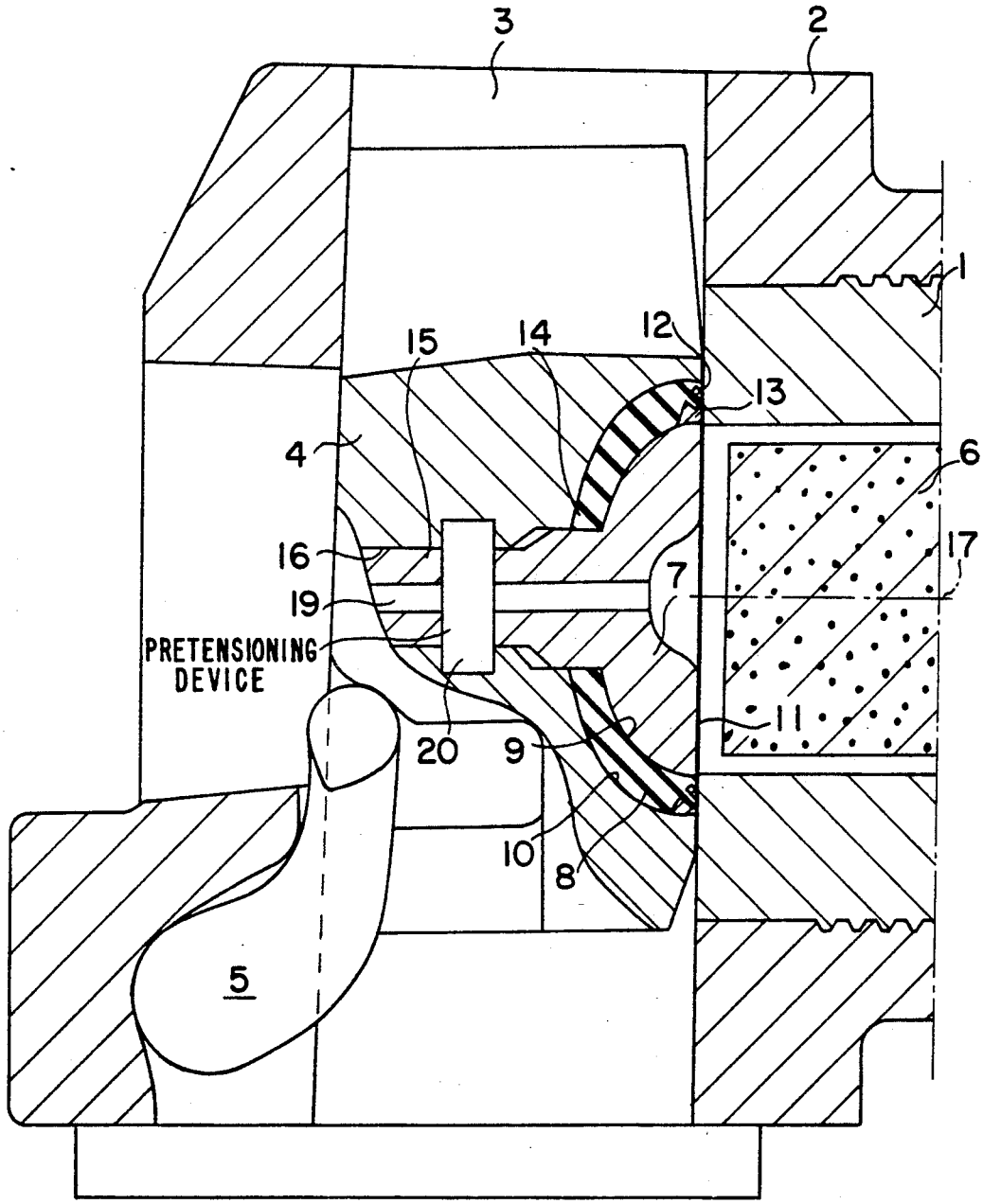
FIG. 2 shows the same section, but with the breech mechanism in the closed position and the gun ready for firing.

When the gun loaded in accordance with FIG. 2 is fired, the gas pressure in the gun barrel will act upon the front face 11 of the seating portion 7. The intermediate layer is thus compressed and may only move slightly in a direction towards the rear portion of the gun barrel 1. The higher the gas pressure acting on the seating portion, the greater will be the force with which the seal is urged about the loading aperture where the material of the intermediate layer is protected from flash jets by the ring 13.

As soon as the pressure in the gun barrel falls, the seating portion and seal return to their respective unloaded positions and the breech may be opened for reloading.

As was mentioned above, the pin 15 may be provided with a pretensioning device 20 which urges it rearwardly in relation to the main portion of the breech mechanism 4 already prior to firing of the gun, in order thereby to urge the intermediate layer 8 into tight abutment already at this point in time. This device may be mechanical or, for instance, hydraulically actuable number of different ways.

The present invention should not be considered as restricted to that described above and shown on the Drawings, many modifications being conceivable without departing from the spirit and scope of the appended claims.

What we claim and desire to secure by Letters Patent is:

1. A breech mechanism for artillery guns including a gun barrel with a loading aperture and a breech member fixedly connected onto the gun barrel, said breech mechanism being displaceable transversely of the rear portion of the gun barrel in a groove extending across the barrel and the breech piece, said breech mechanism comprising:

a main portion and a seating portion disposed therein, said main portion with said seating portion of said breech being displaceable in said groove between a first open position in which the rear portion of the gun with the loading aperture is fully open for loading and a second closed position in which said seating portion entirely covers the loading aperture;

first and second mutually facing surfaces provided on said main portion and said seating portion, said surfaces including convex and conforming concave rotation surfaces respectively, formed from different cams rotated about a common axis, which, when the breech is in the closed position, coincide with the bore axis of the barrel;

a gap formed between said first and second surfaces, the free edges of which at free ends of said gap facing the rear portion of the gun barrel in said second closed position of said breech are positioned in a single plane which is substantially perpendicular to the bore axis, said gap being confined at said free ends by said rear portion in said second closed position; and an intermediate layer made of elastically deformable, substantially non-compressible material and filling said gap, said layer being acted upon and deformable by said seating portion which is restrictedly movable in said main portion in a direction away from the barrel by the gas pressure in the gun;

wherein said intermediate layer on its deformation creeps solely towards the rear portion of the gun barrel along said surfaces of said gap filled by said intermediate layer and is urged into tight abutment with the rear portion of the gun barrel about the loading aperture thereof.

2. The breech mechanism as claimed in claim 1, wherein said elastically deformable intermediate layer is defined by rings of metal along its defining edges in a direction towards the loading aperture and away therefrom, respectively.

3. The breech mechanism as claimed in claim 2, wherein said different cams forming said mutually facing convex and concave surfaces are selected such that the gap formed therebetween and filled by the elastically deformable intermediate layer is flared outwardly in a direction towards the gun barrel.

4. The breech mechanism as claimed in claim 2, wherein the seating portion is guided in the main portion of the breech by means of a central pin which is displaceably disposed in a recess adapted therefore in the main portion of the breech, and wherein the pin head passes through a central aperture in the elastically deformable intermediate layer, said aperture being shod with a ring of metal or other rigid material which prevents the elastically deformable material from creeping in between the pin of the seating portion and its recess in the main portion of the breech.

5. The breech mechanism as claimed in claim 1, wherein said different cams forming said mutually facing convex and concave surfaces are selected such that the gap formed therebetween and filled by the elastically deformable intermediate layer is flared outwardly in a direction towards the gun barrel.

6. The breech mechanism as claimed in claim 1, wherein said seating portion is guided in said main portion of the breech mechanism by means of a central pin which is displaceably disposed in a recess adapted therefore in said main portion and wherein said pin head passes through a central aperture in said elastically deformable intermediate layer, said aperture being shod with a ring of metal which prevents the elastically deformable material from creeping in between the pin of said seating portion and its recess in the main portion of the breech mechanism.

7. The breech mechanism as claimed in claim 1, wherein the mutually facing surfaces of the seating portion and the main portion of the breech respectively have been formed of parts of two different parabolic cams rotated about the same axis.

8. A breech mechanism for artillery guns including a gun barrel with a loading aperture and a breech member fixedly connected onto the gun barrel, said breech mechanism being displaceble transversely of the rear portion of the gun barrel in a groove extending across the barrel and the breech piece, said breech mechanism comprising:

a main portion and a seating portion disposed therein, said main portion with said seating portion of said breech being displaceable in said groove between a first open position in which the rear portion of the gun with the loading aperture is fully open for loading and a second closed position in which said seating portion entirely covers the loading aperture;

first and second mutually facing surfaces provided on said main portion and said seating portion said surfaces including convex and conforming concave rotation surfaces respectively, formed of parts of two different parabolic cams rotated about a common axis, which, when the breech is in the closed position, coincide with the bore axis of the barrel;

a gap formed between said first and second surfaces;

an intermediate layer made of elastically deformable material and disposed in said gap, said layer being acted upon and deformable by said seating portion which is restrictedly movable in said main portion in a direction away from the barrel by the gas pressure in the gun;

wherein said intermediate layer on its deformation creeps solely towards the rear portion of the gun barrel along said surfaces of said gap filled by said intermediate layer and is urged into tight abutment with the rear portion of the gun barrel about the loading aperture thereof.

9. The breech mechanism as claimed in claim 8, wherein said elastically deformable intermediate layer is defined by rings of metal along its defining edges in a direction towards the loading aperture and away therefrom, respectively.

10. The breech mechanism as claimed in claim 8, wherein said different cams forming said mutually facing convex and concave surfaces are selected such that the gap formed therebetween and filled by the elastically deformable intermediate layer is flared outwardly in a direction towards the gun barrel.

11. The breech mechanism as claimed in claim 8, wherein said seating portion is guided in said main portion of the breech mechanism by means of a central pin which is displaceably disposed in a recess adapted therefore in said main portion and wherein said pin head passes through a central aperture in said elastically deformable intermediate layer, said aperture being shod with a ring of metal which prevents the elastically deformable material from creeping in between the pin of said seating portion and its recess in the main portion of the breech mechanism.

12. The breech mechanism as claimed in claim 11, wherein said pin intended for guiding the seating portion in the main portion of the breech mechanism is connected to a pretensioning device for the intermediate layer, with which the pin may be urged rearwardly with respect to the breech mechanism.

13. The breech mechanism as claimed in claim 12, wherein the main portion of the breech is provided with a bevelled oblique keyway towards the rear portion of the gun barrel, the region about the loading aperture of the gun barrel being flat without manifest grooves.

14. The breech mechanism as claimed in claim 8, wherein said main portion of the breech mechanism is provided with a bevelled oblique keyway towards the rear portion of the gun barrel, the region about the loading aperture of the gun barrel being flat without manifest grooves.

* * * * *